US005388696A

United States Patent [19]

Rodriguez Egana

[11] Patent Number: 5,388,696

[45] Date of Patent: Feb. 14, 1995

[54] DISPOSABLE PACKING FOR FLAT GLASS PLATE STACKS FOR THEIR TRANSPORTATION IN KNOWN STANDARD CONTAINERS

[75] Inventor: Tomas Rodriguez Egana, Buenos Aires, Argentina

[73] Assignee: Vidrieria Argentina Sociedad Anonima, Buenos Aires, Argentina

[21] Appl. No.: 111,925

[22] Filed: Aug. 26, 1993

[30] Foreign Application Priority Data

Oct. 5, 1992 [AR] Argentina ..... 323347

[51] Int. Cl.[6] ..... B65D 85/48

[52] U.S. Cl. ..... 206/454; 206/593; 206/594

[58] Field of Search ..... 206/449, 451, 452, 453, 206/454, 521, 591, 594, 592, 593; 211/41

[56] References Cited

U.S. PATENT DOCUMENTS 2,305,405 12/1942 Burrell ..... 206/451
2,839,198 6/1958 Lefevre ..... 206/451
3,569,755 8/1971 Bundy et al. ..... 206/454

FOREIGN PATENT DOCUMENTS 196747 2/1971 Argentina .
1234671 6/1971 United Kingdom ..... 211/41
1634597 3/1991 U.S.S.R. ..... 206/454

*Primary Examiner*—Jimmy G. Foster

[57] ABSTRACT

A disposable packing for flat glass plates can stack the plates for transportation in standard containers. This disposable packing has lateral wooden upstanding posts which rest against the internal walls of the standard container. By using wedges, the upstanding posts are inclined with respect to the internal walls of the container. The angle of inclination between the post and the floor of the container is obtuse. The posts are attached at their base to supporting boards affixed to the floor of the container. The boards have the post affixed to one face while the other face of the boards has a flexible cover. The glass plates are visible at their periphery. The posts have cushioning strips of styropor or plush, for example. A central V-shape space is formed between the packages resting on the post. At least one retaining element can be placed horizontally between the flat glass sheet packages and at least one stopping element can be placed between and in contact with each of the end edges of the packages and the container walls to avoid forward and rearward displacement of the flat glass sheet packages.

7 Claims, 3 Drawing Sheets

DISPOSABLE PACKING FOR FLAT GLASS PLATE STACKS FOR THEIR TRANSPORTATION IN KNOWN STANDARD CONTAINERS

FIELD OF THE INVENTION

This invention relates to a disposable packing for flat glass plate stacks for their transportation in known standard containers.

DESCRIPTION OF THE BACKGROUND ART

Argentine Patent No. 196,747 in the name of Libbey-Owens-Ford Company, Toledo, Ohio, U.S.A., discloses an improved container for the transportation of a plurality of independent glass sheets having different curvature and configurations. This container is returnable to its place of departure, which means an additional cost.

The packings are known of "packages" of flat glass sheets having different dimensions and formed by crates or cages which are adapted to the geometrical configurations of the glass "packages". This known type of packing requires a crate or cage adapted to conform to the geometrical configuration of each one "package" of glass sheets, there being a great variety of sizes of glass plates existing in the market.

Also known are the packings formed by wooden cases of standard dimensions for transporting glass sheets previously conditioned, where the glass sheets must be conditioned by means of supports or auxiliary elements which imply higher packing costs as well as more labor expenses.

The known containers for protecting and transporting "packages" of individual glass sheets must be subsequently hold in place and anchored by means of cleats and boards, thus increasing the use of wood with the resulting cost increment.

In these known type of containers, the whole perimeter of the glass "package" is always covered Completely, and in such a way it is not possible, once the packing is completed, to verify the thickness of the glass sheets and the number of sheets making up the "package".

SUMMARY OF THE INVENTION

It is an object of the present invention to provide a disposable low cost packing which is of light weight and secure and which allows transportation of "packages" of flat glass sheets.

It is another object of this invention to provide a novel disposable packing which gives absolute protection, fastening and anchoring and which is readily usable for a plurality of flat glass sheet "packages" having different dimensions, in standard type containers including those known as "open top type".

It is another object of this invention to provide a disposable packing for the bulk delivery of flat glass sheets in containers and which takes advantage essentially of the structural rigidity characteristics of the known standard containers, as well as of the good resistance against compressive stresses of the glass.

It is another object of this invention to provide a bulk type packing within the container which would allow verification of the thickness and the number of the glass sheets which form the package and the number of the glass sheets which form the package after its packing. In such a way, errors of dispatch would be avoided and the task of the customs personnel intervening in the customs clearance will be made easier.

The disposable packing for the transport of flat glass sheets which is the object of this invention is composed of an assembly of upstanding posts made from wooden rods resting on the internal walls of the container by means of wedges having their surface where the upstanding post rests forming an angle with regard to the surface of the wedge which rests against the internal walls of the container. The posts are fixed at their base to supporting boards disposed on the floor of the container. These supporting boards have a flexible cover where the flat glass sheet packages rest. The "packages" are placed one adjacent to the other and are spaced between them by means of cardboard or styropor spacers, there also being styropor or plush strips disposed on the face of the upstanding posts where the lateral thrust of the glass packages is applied. An horizontal retaining element of rectangular cross-section, having its longer sides provided with a flexible cover with a determined angle of the same value of the angle of the wedges where the lateral post rest on, forms the central horizontal fixing means for the packages. This horizontal retaining element is located at the center of the packing and there may be one or more of such elements linked between them or not, these being the central fixing means for the packages. Other longitudinal retaining elements secure the end edges of the sheet glass packages to the other walls or the floor of the container.

BRIEF DESCRIPTION OF THE DRAWINGS

In order to make more explicit the advantages so stated in short, to which those expert in the arts will be able to add much more, and to facilitate the understanding of the constructive, constituent and functional characteristics of the disposable packing invented, in the following will be described a preferred embodiment as illustrated in the attached figures.

DETAILED DESCRIPTION OF THE PREFERRED EMBODIMENTS

Figure 1:
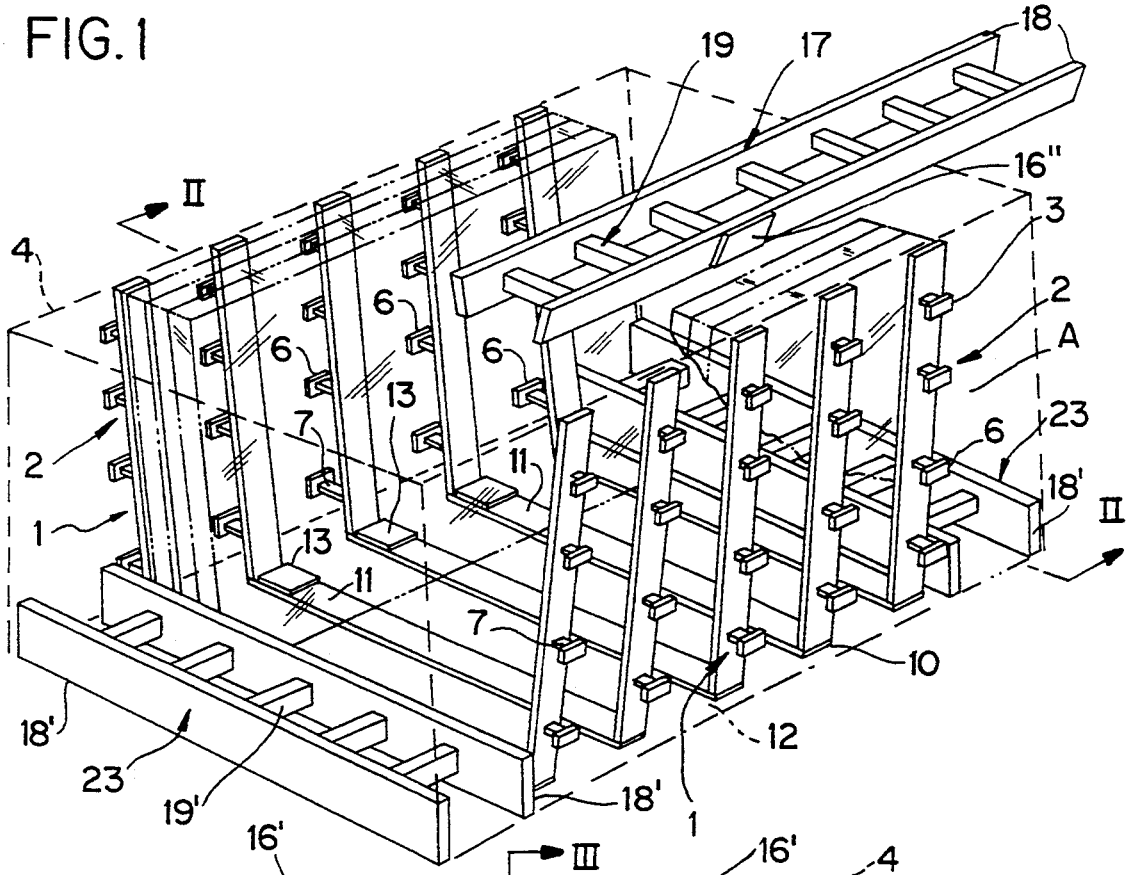
FIG. 1 shows an schematic view in perspective of the instant invention.
Figure 2:
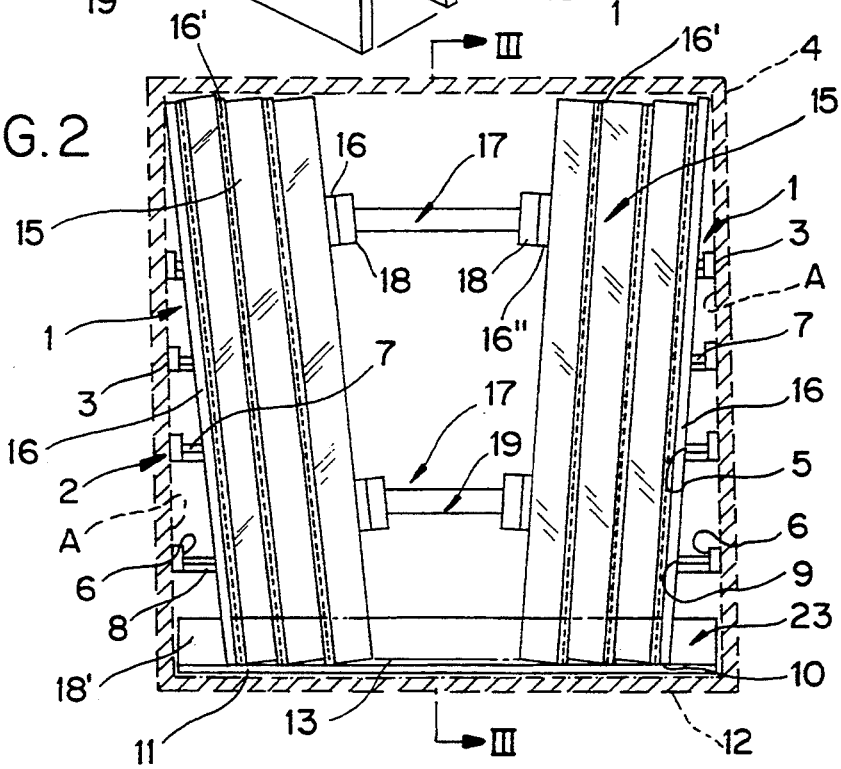
FIG. 2 shows a cross sectional view along the line II—II of FIG. 1.
Figure 3:
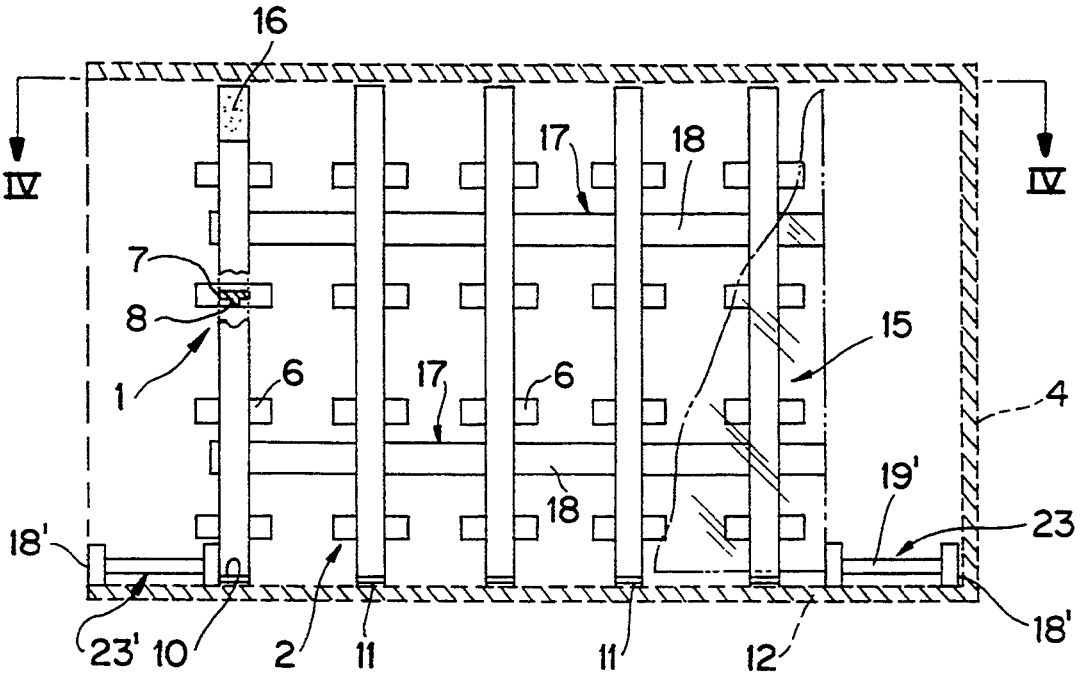
FIG. 3 shows a lengthwise sectional view along the line III—III of FIG. 2.
Figure 4:
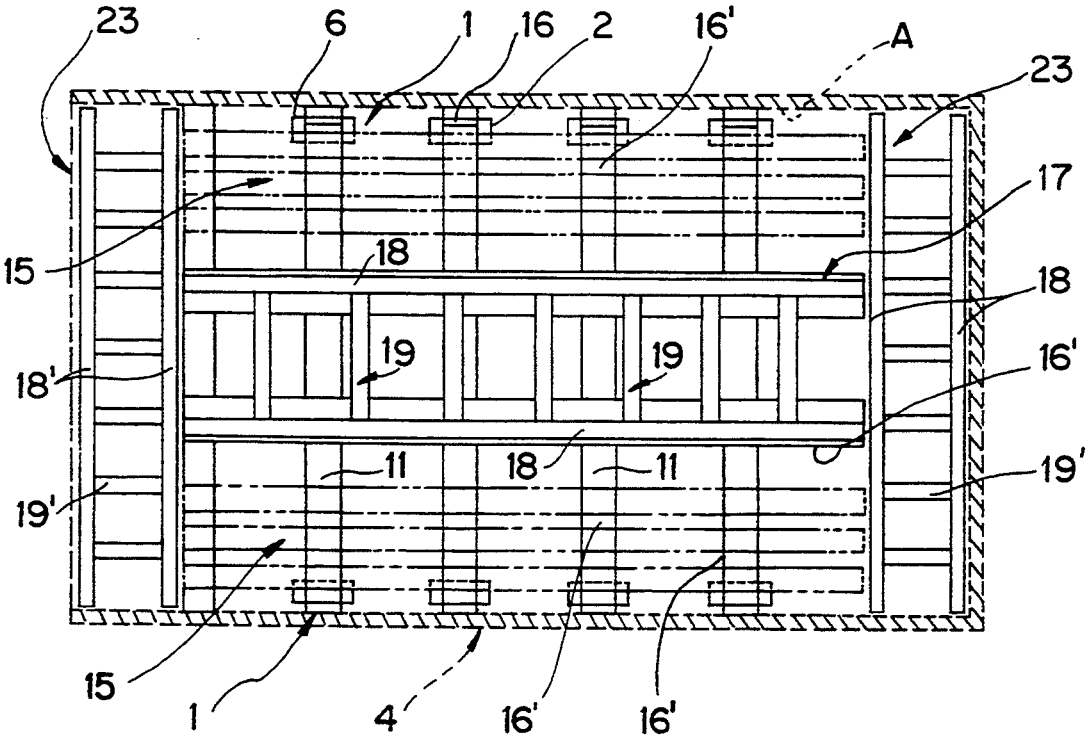
FIG. 4 shows a lengthwise sectional view along line IV—IV of FIG. 3.
Figure 5:
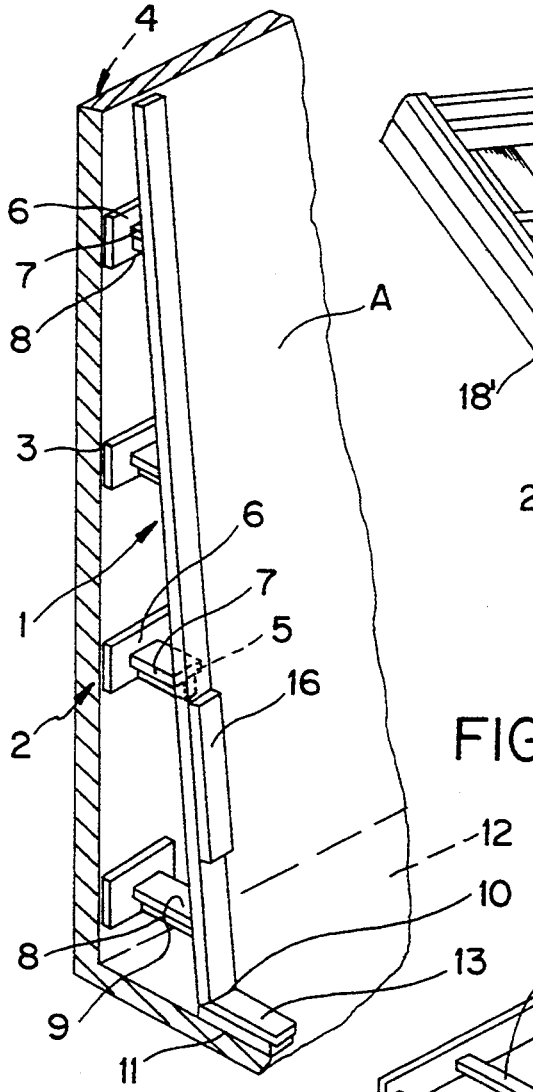
FIG. 5 shows a detail in perspective of one of the lateral posts and wedges, partially segmented.
Figure 7:
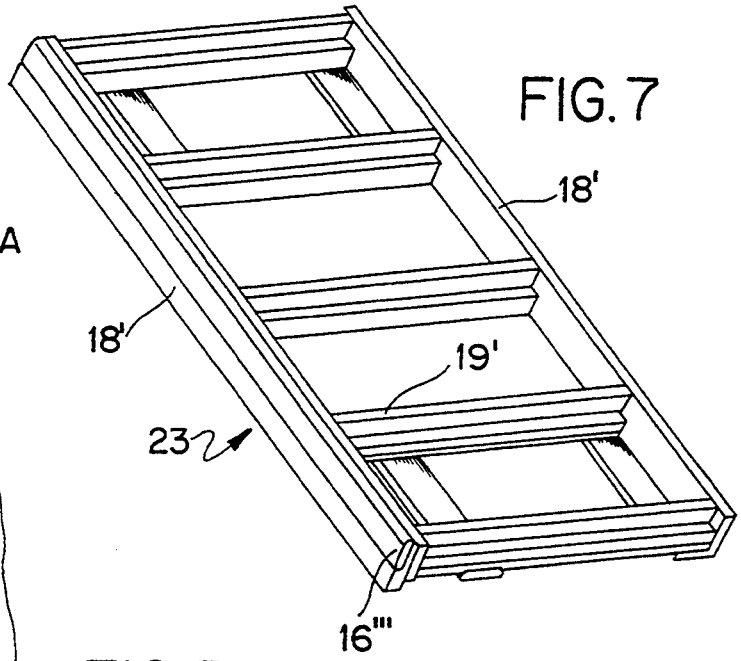
FIG. 7 shows a perspective view of an alternative of the longitudinal retaining elements.
Figure 6:
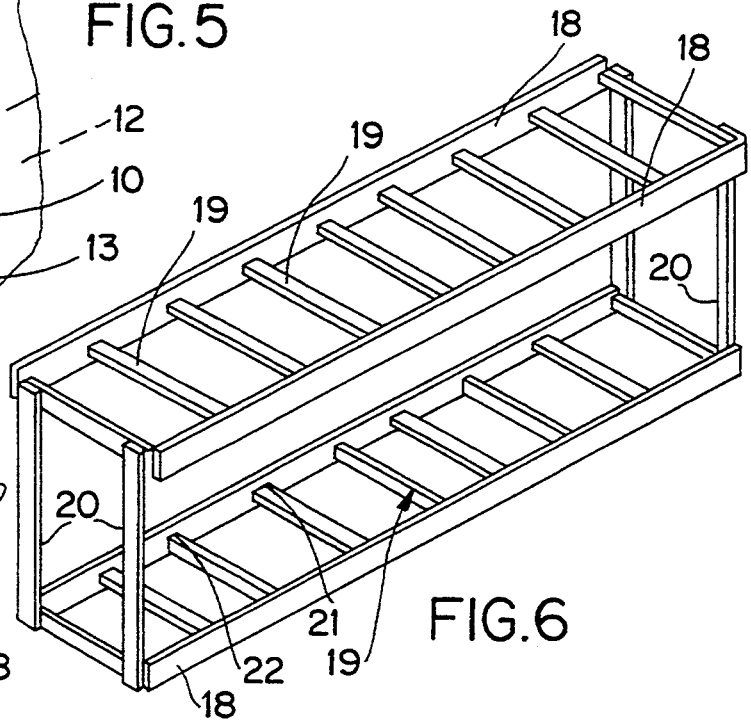
FIG. 6 shows a perspective view of an alternative of the horizontal retaining elements.
Figure 8:
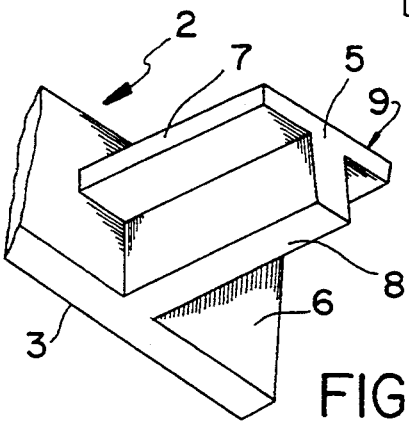
FIG. 8 shows a perspective view of the wedges upon which rest the lateral ports.

In all of the figures, like reference numerals correspond to the same constituent parts or elements, or their equivalents, of the disposable packing according to the instant invention.

The disposable packing consists of lateral posts 1 made of wood, which bear wedges 2 affixed to one of their faces.

Such wedges have surfaces 3 applied to the internal wall A of the container 4, and their other surface 5 showing towards the post 1 with planes forming an angle between them, the thickness of the wedges being variable according to their location on the post. This wedge 2 is formed by a flat rectangular plate 6 which rests with surface 3 against the wall of container 4, to which is affixed another rectangular plate 7 which at the middle of its length has a tie 8 which along with plate 7 constitutes a T-shaped configuration.

End 9 of this T-shaped configuration terminates with a surface forming an angle with respect to post 1.

Lateral post 1 is fixed at its base 10 upon supporting boards 11 which rest upon floor 12 of container 4.

Supporting board 11 has a flexible damping cover 13 formed with a strip of rubber or the like.

The faces of posts 1 where the first flat glass sheet packages 15 rest against are covered with plush or styropor 16.

The flat glass sheet packages 15 are spaced one from another by means of spacers made of cardboard or styropor 16'.

The disposable packing is provided with at least one horizontal retaining element 17 of rectangular cross-section, made up from essentially two wooden boards 18 have a disposed in parallel relationship among them, and spaced by spacers 19. The faces of the wooden boards 18 have a styropor or plush cover 16'' and the surfaces applied against the packages are wedge-formed.

The horizontal retention elements 17 may be one or more than one, and may or may not be linked by means of wooden ties 20.

The spacers 19 are alternately affixed to boards 18 by their faces, in a vertical position 21 or an horizontal position 22.

The disposable packing has, at each end of same, at least one longitudinal retaining element 23 made of wooden boards 18' spaced by means of spacers 19'. The faces of boards 18' are disposed in a parallel relationship among them and have owe of their faces, which rests against the ends of the glass packages, a spacer element 16''' made of styropor or rubber.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

It is claimed:

1. A disposable packing for packages of flat glass sheets for their transportation within standard containers, having internal walls and a floor, the disposable packing comprising lateral wooden upstanding posts resting against the internal walls of a standard container by means of wedges having two opposed flat faces, said upstanding posts being in a position inclined with regard to said walls, said inclination being determined by the inclination of one of the flat faces of said wedges on which said upstanding posts rest, the other, opposed face of said wedge resting on the internal wall of the standard container, the angle of inclination formed by said upstanding post with the floor of the container being obtuse, said upstanding posts having a base and said bases being affixed to one face of supporting boards affixed to the floor of said container, said boards having another face opposed to the one face, the one face of the boards having a flexible cover, the flat glass sheet packages being located adjacent one to the other and applied upon said flexible cover, the glass packages being visible at their periphery and resting laterally on a resting face of said posts, the posts having on their resting faces cushioning strips, a central V-shaped space being formed by said packages resting on said posts, and comprising at least one retaining element placed horizontally between and in contact with the flat glass sheet packages, and at least one stopping element located between and in contact with each end edge of said packages and the container walls for avoiding forward and rearward displacement of the flat glass sheet packages.

2. The packing as claimed in claim 1, wherein said wedge comprises a second flat rectangular plate having one plate face support of the flat glass sheet package and being provided on another face of at least two T-shaped configurations, the T-shaped configurations having a horizontal bar and the horizontal bar of the T-shaped configurations being formed by a first flat rectangular plate having one flat face contacting with the wall of the container.

3. The packing as claimed in claim 2, wherein distance between the one plate of the second flat rectangular plate and the one flat face of the first flat rectangular plates is variable.

4. The packing as claimed in claim 1, wherein said retaining element is of rectangular cross-section and has its longer sides formed by boards joined together by means of separators, said boards being mounted in a parallel relationship among them and having its free faces forming a wedge.

5. The packing as claimed in claim 1, wherein said stopping element being formed with parallel boards and having further spacers which join the same.

6. The packing as claimed in claim 1, wherein the retaining elements have a styropor or plush cover on their faces in contact with the flat glass sheet package.

7. The packing as claimed in claim 1, wherein the stopping elements have a styropor or plush cover.

* * * * *